United States Patent [19]

Obuchi

[11] 4,057,694

[45] Nov. 8, 1977

[54] SPEAKER DIAPHRAGM HAVING FLAT RESPONSE CURVE

[75] Inventor: Akio Obuchi, Tokorozawa, Japan

[73] Assignee: Pioneer Electronic Corporation, Tokyo, Japan

[21] Appl. No.: 734,691

[22] Filed: Oct. 21, 1976

[30] Foreign Application Priority Data

Oct. 23, 1975 Japan ..... 50-126858

[51] Int. Cl.[2] ..... H04R 9/06

[52] U.S. Cl. ..... 179/115.5 R

[58] Field of Search ..... 179/115.5 R, 180, 181 R; 181/157-161, 163-167, 171-174

*Primary Examiner*—George G. Stellar

*Attorney, Agent, or Firm*—Sughrue, Rothwell, Mion, Zinn and Macpeak

[57] ABSTRACT

The nodal circle between the inner and outer concentric portions of an audio speaker diaphragm is positioned so that the ratio of the areas of the inner and outer portions is approximately equal to the ratio of their respective masses, whereby the frequency response curve remains relatively flat and is not affected by first order resonance.

6 Claims, 7 Drawing Figures

SPEAKER DIAPHRAGM HAVING FLAT RESPONSE CURVE

BACKGROUND OF THE INVENTION

This invention relates to a diaphragm for a speaker or tweeter having improved frequency versus acoustic pressure response characteristics.

In conventional speaker diaphragms made of materials such as aluminum, titanium, paper, or the like, which have low internal loss characteristics, the first order or first harmonic resonance peak occurs, or at least begins to occur, at an unacceptably low frequency, i.e. at a frequency still within the audible range. Heretofore, in order to obtain flatter frequency vs. acoustic pressure responses in such diaphragms, separate equalizers have been employed or a mechanical impedance has been provided in the vicinity of the nodal circle of the diaphragm, i.e. the circle where the vibrations "split" or become reversed in phase. Such solutions to the problem are relatively complicated and costly, however.

SUMMARY OF THE INVENTION

Therefore, it is an object of this invention to provide a speaker diaphragm having a flat frequency vs. acoustic pressure response characteristic. To achieve this the nodal circle is set at a predetermined position on the diaphragm so that no sharp peaks occur in the total acoustic pressure radiated by the diaphragm when it vibrates in a split mode, whereby the first order resonance does not adversely affect the acoustic pressure.

Briefly, and in accordance with the invention, this object is achieved by setting the nodal circle at a position such that the ratio of the areas of the inner and outer concentric portions of the speaker is approximately equal to the ratio of their respective masses, such masses including those of the speaker portions, the voice coil, and the boundary layer of air surrounding the diaphragm.

DETAILED DESCRIPTION OF THE PREFERRED EMBODIMENT

Figure 1:
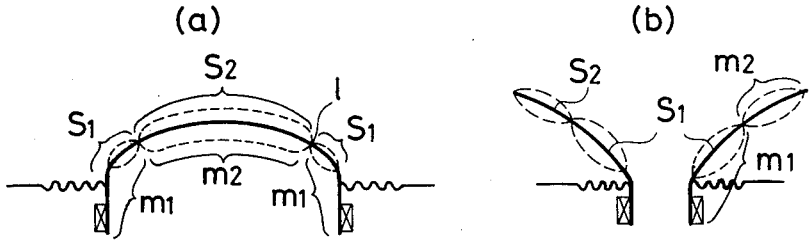
FIG. 1(*a*) shows a sectional view of a dome-shaped split vibration type speaker diaphragm, FIG. 1(*b*) shows a sectional view of a cone-shaped split vibration type speaker diaphragm.

In the dome-shaped speaker shown in FIG. 1(*a*), $S_1$ and $S_2$ are the areas of the outer and inner portions of the diaphragm, respectively, divided by the nodal circle l. The total mass of the outer portion of the diaphragm, the mass of the voice coil, and the mass of the boundary air surrounding the outer portion is represented by $m_1$. The total mass of the inner portion of the diaphragm and the mass of the boundary air surrounding it is represented by $m_2$.

Figure 2:
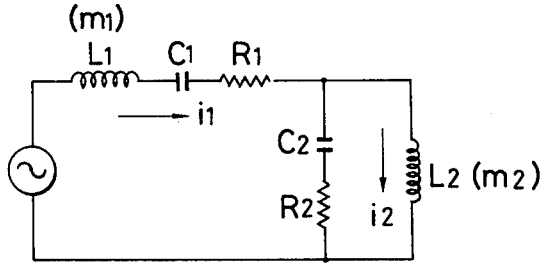
FIG. 2 shows a schematic diagram of an equivalent circuit for the speaker of FIG. 1(*a*), FIGS. 3(*a*), 3(*b*) and 3(*c*) show frequency response curves for various mass and area ratios.

FIG. 2 shows an equivalent electrical circuit for the dome-shaped speaker of FIG. 1(*a*), wherein:

$L_1$ corresponds to $m_1$, $C_1$ corresponds to the compliance of the speaker suspension, $R_1$ corresponds to the resistance of the speaker suspension, $L_2$ corresponds to $m_2$, $C_2$ corresponds to the compliance of the nodal circle, and $R_2$ corresponds to the internal loss resistance of the diaphragm material.

The acoustic pressures $P_1$ and $P_2$ generated by $S_1$ and $S_2$, respectively, and measured at a point remote from the diaphragm by a distance *r*, may be expressed as follows:

$$P_1 = (P_o WS_1)/(2\pi r)\, V_1$$

$$P_2 = (P_o WS_2)/(2\pi r)\, V_2 \qquad (1)$$

where:

$P_o$ corresponds to the air density, $V_1$ corresponds to the vibration velocity of the area $S_1$, $V_2$ corresponds to the vibration velocity of the area $S_2$, and W corresponds to the audio signal angular frequency ($2\pi f$).

From equation (1), the following acoustic pressure proportional equations can be established.

$$P_1 \alpha P_1' = WS_1 i_1$$

$$P_2 \alpha P_2' = WS_2 i_2 \qquad (2)$$

where $P_1'$ and $P_2'$ are vector quantities corresponding to the absolute pressures $P_1$ and $P_2$, and $i_1$ and $i_2$ are the equivalent circuit currents shown in FIG. 2.

The total acoustic pressure (P) produced by the diaphragm is proportional to the vector sum of ($P_1'$) and ($P_2'$), and consequently it is possible to determine the acoustic pressure characteristics of a speaker by measuring or calculating $i_1$ and $i_2$ in the equivalent circuit shown in FIG. 2, and calculating therefrom the vector sum of ($WS_1 i_1$) and ($WS_2 i_2$).

Figure 3A:
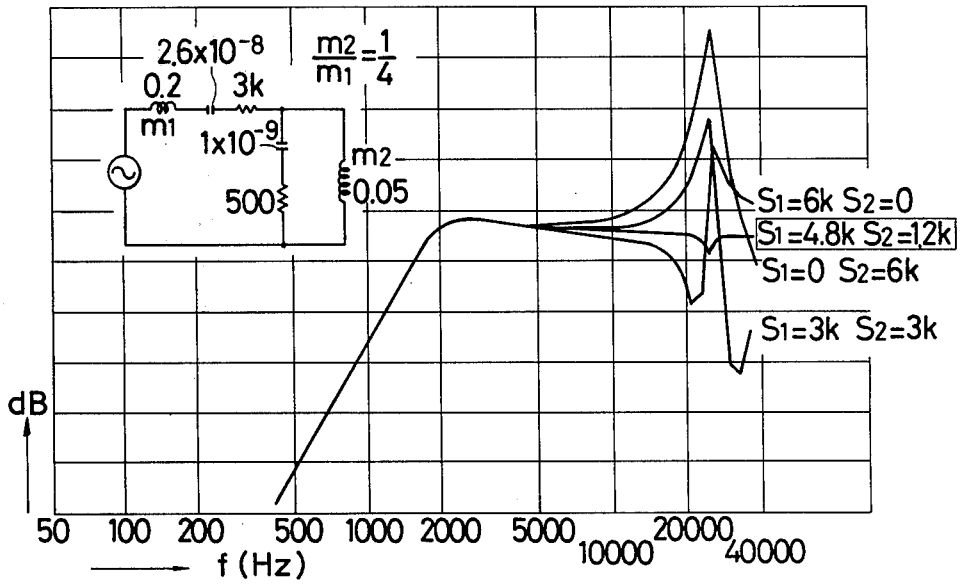
Figure 3B:
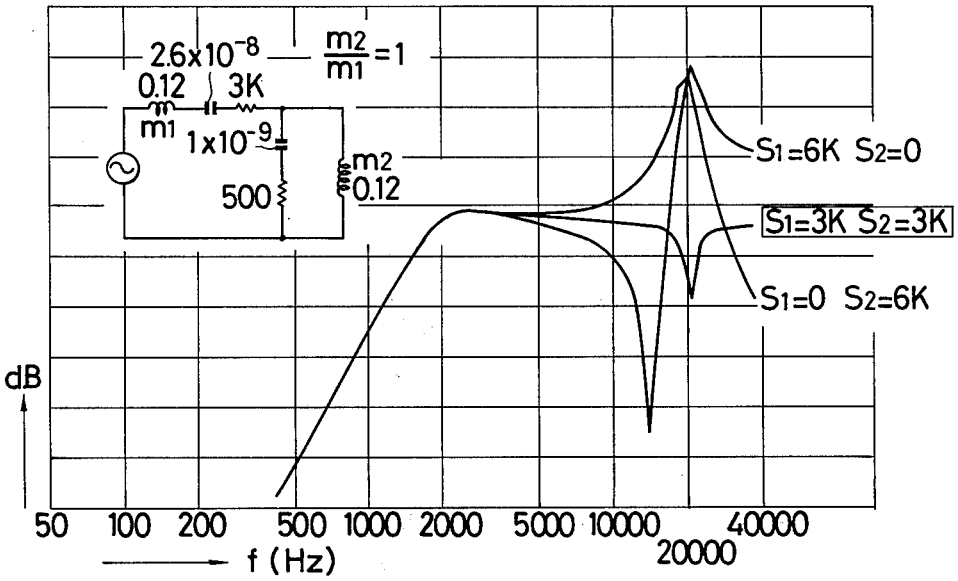
Figure 3C:
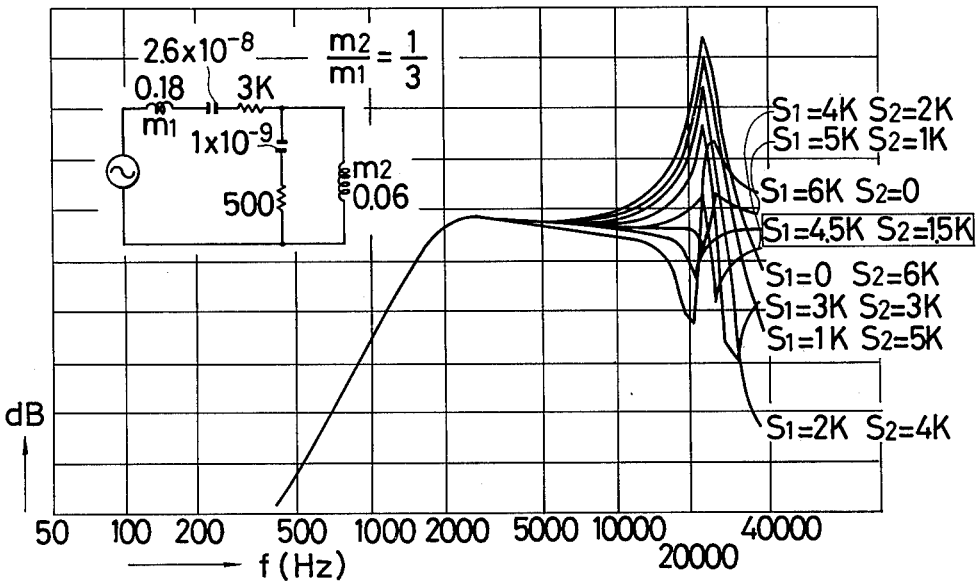
Figure 4:
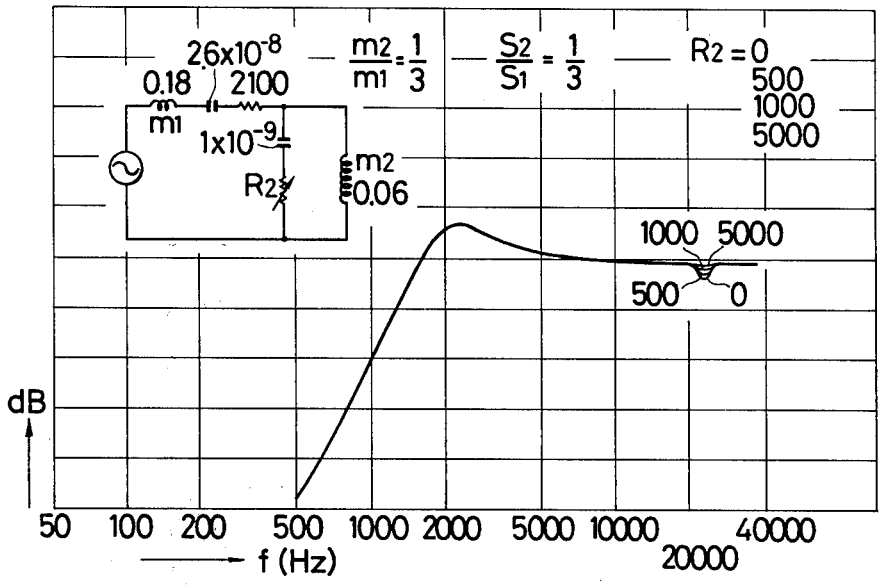
FIG. 4 shows frequency response curves where the mass and area ratios are equal, and the diaphragm material is varied.

Speaker characteristics calculated in this manner are shown in FIGS. 3 and 4. FIGS. 3(*a*)–3(*c*) show the acoustic pressure characteristics obtained for different constant mass ratios ($m_1$) to ($m_2$) and various area ratios ($S_1$) to ($S_2$). As can easily be seen, when $S_2/S_1$ is equal to $m_2/m_1$, the first order resonance effect is considerably diminished and the acoustic pressure is not adversely affected because the frequency response curve becomes relatively flat.

FIG. 4 shows a series of acoustic pressure response curves or characteristics obtained when $m_2/m_1 = S_2/S_1 = 1/3$ is constant, and the diaphragm material, and therefore the internal loss resistance of the speaker, is varied. As may be clearly seen, such speaker material variations have no significant effect on the acoustic pressure characteristics, and the response curves remain flat throughout the upper audio range.

As is apparent from the foregoing description, if the nodal circle is positioned so that $m_2/m_1 = S_2/S_1$, it is possible to almost completely suppress first order high frequency resonance effects, and the acoustic pressure characteristics are not affected by the diaphragm material. Such positioning or adjustment of the nodal circle location may be implemented by appropriately selecting the speaker diaphragm dimensions, the mass of the voice coil, etc.

In actual practice it may be somewhat difficult to make the area ratio exactly equal to the mass ratio. Some degree of variance is easily acceptable, however, without unduly affecting the desired performance characteristics. Thus, considering physical variations in the components of a given speaker, particularly in the case of diaphragms for cone-shaped speakers, it is acceptable to maintain a tolerance of 0.8 – 1.2 between the respective ratios. That is, it is acceptable if $S_2/S_1 = (0.8 - 1.2)\ m_2/m_1$.

What is claimed is:

1. In a audio speaker including a diaphragm having concentric, contiguous inner and outer portions, said diaphragm being adapted to vibrate in a split mode wherein the interface between said inner and outer portions is defined by a nodal circle, and a voice coil operatively associated with one of said portions, the improvement characterized by:

the nodal circle being positioned such that the ratio $S_i : S_o$ is approximately equal to the ratio $m_i : m_o$, where $S_i$ is the surface area of the inner portion, $S_o$ is the surface area of the outer portion, $m_i$ is the mass of the inner portion, and $m_o$ is the mass of the outer portion.

2. An audio speaker as defined in claim 1, wherein the diaphragm is dome-shaped, the voice coil is associated with the outer portion, $m_i$ includes the mass of the inner portion of the diaphragm and the mass of the boundary air surrounding it, and $m_o$ includes the mass of the outer portion of the diaphragm, the mass of the boundary air surrounding it, and the mass of the voice coil.

3. An audio speaker as defined in claim 1, wherein the diaphragm in cone-shaped, the voice coil is associated with the inner portion, $m_i$ includes the mass of the inner portion of the diaphragm, the mass of the boundary air surrounding it, and the mass of the voice coil, and $m_o$ includes the mass of the outer portion of the diaphragm and the mass of the boundary air surrounding it.

4. An audio speaker as defined in claim 1, wherein $S_i : S_o = (0.8 - 1.2)m_i : m_o$.

5. An audio speaker as defined in claim 2, wherein $S_i : S_o = (0.8 - 1.2)m_i : m_o$.

6. An audio speaker as defined in claim 3, wherein $S_i : S_o = (0.8 - 1.2)m_i : m_o$.

* * * * *